US005191619A

United States Patent [19]

Hayase

[11] Patent Number: 5,191,619

[45] Date of Patent: Mar. 2, 1993

[54] BASS ENHANCING DEVICE FOR A SPEAKER SYSTEM

[75] Inventor: Toru Hayase, Higashihiroshima, Japan

[73] Assignee: Sharp Kabushiki Kaisha, Osaka, Japan

[21] Appl. No.: 646,277

[22] Filed: Jan. 28, 1991

[30] Foreign Application Priority Data

Feb. 7, 1990 [JP] Japan ..... 2-27687

[51] Int. Cl.[5] ..... H04R 3/00

[52] U.S. Cl. ..... 381/96

[58] Field of Search ..... 381/96, 59, 89, 88, 381/90

[56] References Cited

U.S. PATENT DOCUMENTS 4,741,040 4/1988 Kaizer ..... 381/96

FOREIGN PATENT DOCUMENTS 5-112097 8/1980 Japan .
58-103292 6/1983 Japan .
1-285262 10/1989 Japan .
1-285263 10/1989 Japan .
1-285264 10/1989 Japan .

*Primary Examiner*—Forester W. Isen

[57] ABSTRACT

A bass enhancing device for a speaker system a bass enhancing member that increases base range sound waves by vibrating according to sound waves emitted by a speaker unit. The bass enhancing member has a bass range resonant frequency that differs from a frequency at which an amplitude of vibration speed of the speaker system becomes largest. Further, vibration detecting device for detecting vibrations of the bass enhancing member and releasing a detecting current is provided, for example, in the bass enhancing member. The detecting current is fed back to amplification device by feedback device. According to this arrangement, bass range acoustic characteristics are improved without lowering vibration efficiency of a vibrating system of a speaker unit and without increasing structural complexity of the speaker unit.

7 Claims, 2 Drawing Sheets

BASS ENHANCING DEVICE FOR A SPEAKER SYSTEM

FIELD OF THE INVENTION

The present invention relates to a bass enhancing device for a speaker system attached to an audio reproducing device having the speaker system and an amplifier that drives the speaker system.

BACKGROUND OF THE INVENTION

A speaker system comprises, for example, a speaker and a cabinet that supports the speaker. A speaker system having superior acoustic characteristics can emit into free space sound waves having frequencies extending over a wide range, from the treble range to the bass range. Consequently, speaker systems currently in use possess a plurality of lowest resonant frequencies according to a plurality of speakers being provided therein, these speakers having a similar structure but of different sizes. Accordingly, speaker systems can emit sound waves having frequencies extending over a wide range.

However, since sound waves are emitted by vibrations of the diaphragm (for example, a cone-shaped diaphragm) of a speaker, phases of sound waves in front of and behind the diaphragm become mutually opposite. Consequently, sound waves emitted from the front of the diaphragm and those emitted from the rear of the diaphragm mutually cancel each other out. This mutual cancelling out resulting from mutually opposite phases is remarkable particularly in the bass range.

In order to enhance bass range sound waves, a bass enhancing member such as a passive radiator or a bass reflex duct are provided in the cabinet of the speaker system. Other bass enhancing devices may be added if the bass enhancing member does not satisfactorily enhance the bass range sound waves.

A conventional bass enhancing device enhances a specified audio-frequency range in a boost circuit of an amplifier, or carries out MFB (Motional Feed Back) to the amplifier according to an output of a vibration detecting sensor provided in the speaker system that is driven by the amplifier. Where such a bass enhancing device is provided, the acoustic characteristics of the speaker system improve from the treble range to the bass range.

However, in conventional bass enhancing devices, in the case where a resonant frequency of the diaphragm falls within the specified audio-frequency range enhanced by the boost circuit, the speaker unit including the diaphragm are driven by electrical power enhanced at a vicinity of the resonant frequency of the diaphragm. As a result, a mechanically and acoustically undesirable problem arises whereby the vibrating system is damaged due to excessive amplitude of vibration or, even if no damage occurs, sound tends to become distorted in the vicinity of the resonant frequency. This is because the vibrating system on being driven deviates from a state wherein linearity is maintained.

On the other hand, in the case where bass enhancing devices, wherein MFB is carried out to the amplifier according to the output of the vibration detecting sensor, use a speed-type MFB method, the damaging effect of excessive amplitude of vibration is reduced since a damping power exerted on the diaphragm increases. However, some sort of vibration detector must be attached to the vibrating system of the speaker unit that is driven by the amplifier. As a result, the weight of the vibrating system increases due to the vibration detector being attached thereon and problems appear such as reduced vibration efficiency of the speaker unit, as well as a more complicated structure of the speaker unit.

SUMMARY OF THE INVENTION

It is an object of the present invention to provide a bass enhancing device for a speaker system, having a bass range resonant frequency that differs from a resonant frequency of a diaphragm in a speaker unit and capable of improving bass range acoustic characteristics of the speaker unit without increasing the weight or structural complexity thereof.

In order to achieve the above object, a bass enhancing device for a speaker system related to the present invention is provided with at least the following means:

(a) amplifying means for amplifying an alternating current that includes a sound signal;

(b) speaker unit means for emitting sound waves, being driven according to a signal current released by the amplifying means;

(c) a bass enhancing member (for example, a passive radiator or a bass reflex duct) that enhances bass range sound waves, driven by the sound waves emitted by the speaker unit means and resonating with a bass range resonant frequency that differs from a frequency at which the amplitude of vibration speed of the speaker unit means becomes largest;

(d) vibration detecting means (for example, an vibration detecting coil), provided in the bass enhancing member, that detects vibrations of the bass enhancing member and then releases a detecting current; and (e) feedback means for further amplifying the signal current released by the amplifying means by feeding back the detecting current released by the vibration detecting means to the amplifying means.

With the above arrangement, the bass enhancing member vibrates strongly in a vicinity of the bass range resonant frequency according to the sound waves emitted by the speaker unit means. The vibrations of the bass enhancing member are converted to the detecting current by the vibration detecting means. The detecting current is sent to the amplifying means via the feedback means. As a result, the amplifying means further amplifies the signal current and sends it to the speaker unit means.

The bass range resonant frequency of the bass enhancing member differs from the frequency at which the amplitude of vibration speed of the speaker unit means becomes largest. Consequently, even if an output of the amplification means becomes larger in the vicinity of the bass range resonant frequency, the speaker unit means does not vibrate excessively. Thus, since the feedback means is used only for enlarging the vibrations of the bass enhancing member, damage to the speaker unit means or distortion of sound due to resonance is prevented and the bass range acoustic characteristics are improved.

Further, since the vibration detecting means is provided in the bass enhancing member, the speaker system can enlarge the bass range output of the amplification means without causing a fall in the vibration efficiency of the vibrating system due to an increase in the weight thereof and without causing an increase in the complexity of the structure thereof.

For a fuller understanding of the nature and advantages of the invention, reference should be made to the ensuing detailed description taken in conjunction with the accompanying drawing.

However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus is not limitative of the present invention, and wherein.

DESCRIPTION OF THE EMBODIMENT

Figure 1:
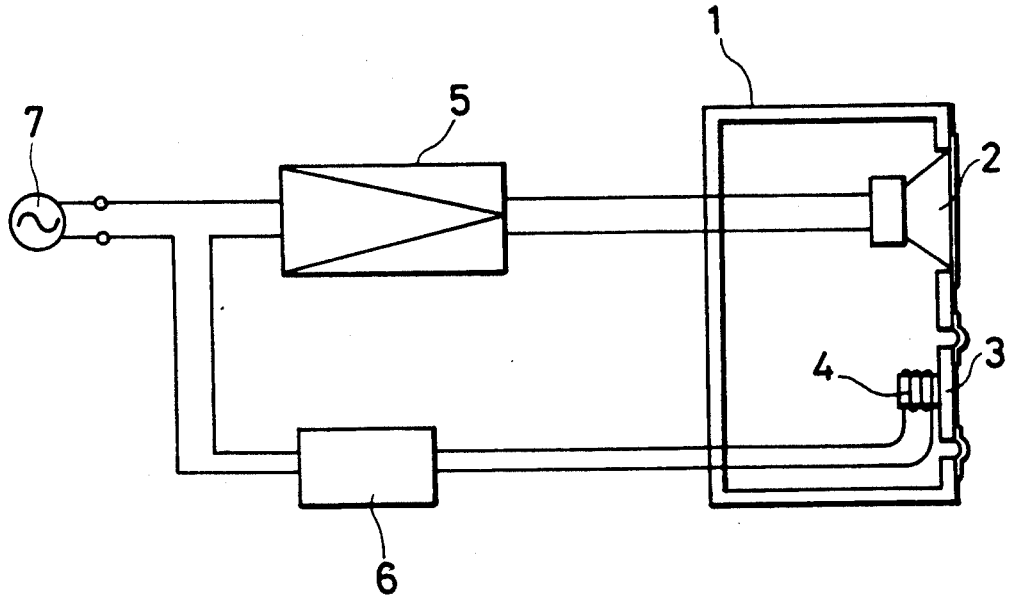
FIG. 1 is a schematic illustration of the structure of a speaker system that is an embodiment of the present invention.

The following is a description of one embodiment of the present invention and refers to FIG. 1.

As shown in FIG. 1, a bass enhancing device related to the present invention is used in a speaker system comprising, for example, a speaker unit 2 that emits sound waves into free space and a cabinet 1 that is particularly suitable for bass range sound waves and that supports a front part of the speaker unit 2. The speaker unit 2 comprises a diaphragm, such as a cone-shaped diaphragm or a horizontal-type diaphragm, that emits the sound waves by causing a gaseous medium to vibrate. In the center of the diaphragm, a magnet, a center pole and a yoke are arranged so as to constitute a magnetic circuit. According to this arrangement, a strong cylindrical magnetic field is generated in the center pole.

Further, a voice coil is wound around the center pole section of the diaphragm. The voice coil is conjoined with the diaphragm so as to transfer vibrations of the voice coil to the diaphragm. The voice coil is also connected to an amplifier 5 serving as amplifying means for amplifying an alternating current including a sound signal. The voice coil is thus supplied with a signal current amplified by the amplifier 5. Since the cylindrical magnetic field exerts a force on the voice coil according to Fleming's left-hand rule, the voice coil is set to vibrate by the force. Moreover, one input terminal of the amplifier 5 is connected to an alternating current generating source 7 that generates the alternating current, another input terminal being connected to a feedback circuit 6 described later.

Further, a passive radiator 3 is arranged under the speaker unit 2 connected to the amplifier 5. The passive radiator 3 serves as a bass enhancing member that enhances the bass range sound waves by vibrating due to the sound waves emitted by the speaker unit 2 and resonating with a bass range resonant frequency that differs from a frequency at which an amplitude of vibration speed of the speaker unit 2 becomes largest. The passive radiator 3 essentially consists of a diaphragm and is indirectly driven by a resonant system determined according to air compliance within the cabinet 1, compliance of a suspension that supports the passive radiator 3 and the mass of the passive radiator 3 itself.

A vibration detecting coil 4 is provided in a rear part of the passive radiator 3. The vibration detecting coil 4 generates a detecting current according to vibrations of the passive radiator 3. The vibration detecting coil 4 and a magnetic circuit constituting member (not shown) provided in the vicinity of the vibration detecting coil 4 serve as vibration detecting means. The vibration detecting coil 4 is connected to the feedback circuit 6 serving as feedback means for converting the detecting current to a detecting signal having a suitable feedback level. The feedback circuit 6 is connected to the amplifier 5 as well as the alternating current generating source 7. Furthermore, an even more suitable detecting signal may be supplied to the amplifier 5 by providing a band limiting circuit, a differentiating circuit, or an integrating circuit or the like between the feedback circuit 6 and the amplifier 5.

Based on the above arrangement, a description follows of the operation of the bass enhancing device when the speaker system is in operation.

First, the alternating current including the sound signal is supplied to the amplifier 5 from the alternating current generating source 7. The alternating current is then supplied to the voice coil of the speaker unit 2 after being amplified by the amplifier 5. The voice coil is supplied with the amplified signal current and vibrates due to the force exerted thereon by the interaction of the signal current and the cylindrical magnetic field generated by the magnet, the center pole and the yoke. The vibrations are transferred to the diaphragm attached to the voice coil. Sound waves are then emitted according to the vibrations of the diaphragm.

Sound waves emitted into the cabinet 1 according to the vibrations of the diaphragm cause the passive radiator 3 to vibrate most in the vicinity of its bass range resonant frequency. According to this arrangement, the passive radiator 3 emits the bass range sound waves efficiently.

The vibrations of the passive radiator 3 are detected by the vibration detecting coil 4 and the detecting current is entered to the amplifier 5 via the feedback circuit 6. In the case of positive feedback, the output of the amplifier 5 increases when the passive radiator 3 vibrates in the vicinity of its bass range resonant frequency, since the feedback amount of the detecting current increases when the passive radiator 3 vibrates in the vicinity of its bass range resonant frequency. A vibration amplitude of the diaphragm in the speaker unit 2 becomes small in an audio-frequency range within which the passive radiator 3 vibrates most since the bass range resonant frequency of the passive radiator 3 differs from the frequency at which the amplitude of vibration speed of the speaker unit 2 becomes largest. Consequently, the diaphragm in the speaker unit 2 does not vibrate excessively even when the output of the amplifier 5 increases due to the vibrations of the passive radiator 3 in the vicinity of the bass range resonant frequency, thus preventing problems like damage to the diaphragm or distortion of sound.

Thus, the bass enhancing device related to the present embodiment increases an acoustic output of the bass range sound waves by detecting the vibrations of the passive radiator 3 and feeding back the detecting current obtained according to these vibrations to the amplifier 5. The passive radiator 3 vibrates since it resonates at a bass range resonant frequency differing from the frequency at which the amplitude of vibration speed of the speaker unit 2 becomes largest. Consequently, the increase in the output of the amplifier 5 in the vicinity of the bass range resonant frequency of the passive radiator 3 increases the vibrations only of the passive radiator 3, rather than causing the diaphragm in the speaker unit 2 to vibrate. In this way, bass range acoustic characteristics of the speaker system improve since the acoustic output of the passive radiator 3 increases in the bass range.

Furthermore, in the speaker system related to the present invention, the vibration detecting coil 4 is provided on the passive radiator 3, not on the vibrating system of the speaker unit 2. According to this arrangement, the speaker system related to the present invention can increase the output of the amplifier 5 in the bass range without lowering the vibration efficiency of the vibrating system in the speaker unit 2 due to an increase in the weight and without complicating the structure of the speaker unit 2.

Moreover, the vibration detecting means related to the present invention can also be made of a voice coil, a field coil and other members that constitute a magnetic circuit in the same way as, for example, an electromagnetic speaker. In such a case, it becomes possible for the speaker system to improve the bass range acoustic characteristics by feeding back the detecting current released by the field coil of the vibration detecting means to the amplifier.

Figure 2:
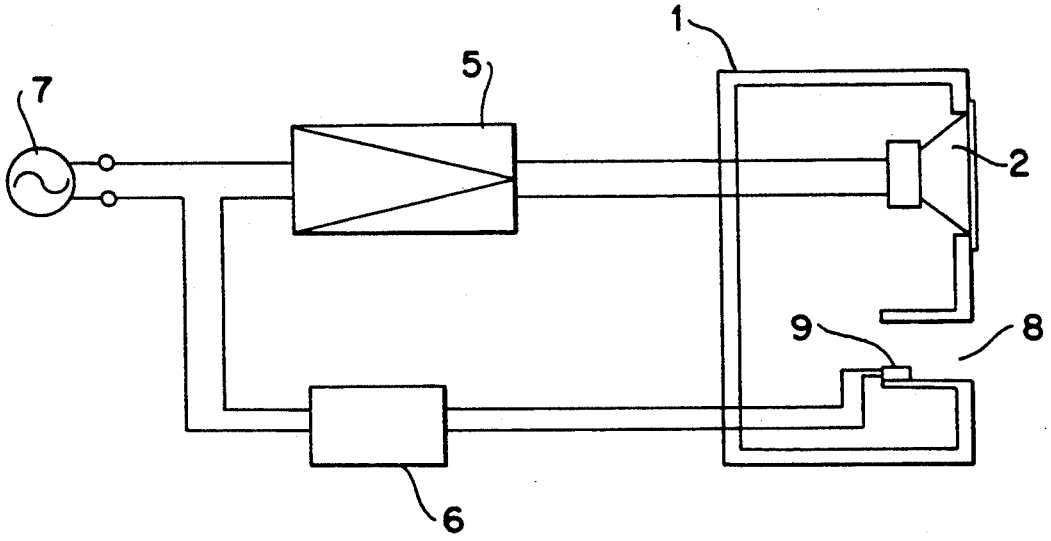
FIG. 2 shows a second embodiment of the invention.

Further, the passive radiator 3 has been used in the present invention as the bass enhancing member, but, for example, a bass reflex duct 8 may equally be used as shown in FIG. 2. In this case, feedback signal is generated based on the output of a detector 9 that detects the speed of flow of a gaseous medium through the bass reflex duct 8.

The invention being thus described, it may be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A bass enhancing device for a speaker system, comprising:

amplifying means for amplifying an alternating current that includes a sound signal;

speaker unit means for emitting sound waves, being driven according to a signal current released by the amplifying means;

a bass enhancing member that enhances bass range sound waves by resonating with a bass range resonant frequency differing from a frequency at which the amplitude of vibration speed of the speaker unit means becomes largest, the bass enhancing member being driven by the sound waves emitted by the speaker unit means;

vibration detecting means, included in the bass enhancing member, for detecting vibrations of the bass enhancing member and for releasing a detecting current; and feedback means for further amplifying the signal current released by the amplifying means by positive feed back of the detecting current released by the vibration detecting means to the amplifying means.

2. The bass enhancing device for a speaker system as set forth in claim 1, wherein the speaker system comprises cabinet means for supporting a front part of the speaker unit means.

3. The bass enhancing device for a speaker system as set forth in claim 1, wherein the speaker unit means comprises a diaphragm that emits sound waves by causing a gaseous medium to vibrate.

4. The bass enhancing device for a speaker system as set forth in claim 2, wherein the bass enhancing member comprises a passive radiator and a suspension for supporting the passive radiator, the passive radiator essentially consisting of a diaphragm, and being indirectly driven by a resonant system determined according to air compliance within the cabinet, compliance of the suspension that supports the passive radiator and the mass of the passive radiator itself.

5. A bass enhancing device for a speaker system, comprising:

amplifying means for amplifying an alternating current that includes a sound signal;

speaker unit means for emitting sound waves, being driven according to a signal current released by the amplifying means;

bass reflex duct means for enhancing bass range sound waves by causing a gaseous medium to resonate according to sound waves emitted by the speaker unit means at a bass range resonant frequency differing from a frequency at which an amplitude of vibration speed of the speaker unit means becomes largest frequency;

vibration detecting means for detecting a speed of flow of a gaseous medium through the bass reflex duct and for releasing a detecting current; and feedback means for further amplifying the signal current released by the amplifying means by feeding back the detecting current released by the vibration detecting means to the amplifying means.

6. The bass enhancing device for a speaker system as set forth in claim 5, wherein the speaker system comprises cabinet means for supporting a front part of the speaker unit means.

7. The bass enhancing device for a speaker system as set forth in claim 5, wherein the speaker unit means comprises a diaphragm that emits sound waves by causing a gaseous medium to vibrate.

* * * * *